United States Patent [19]

Townsend

[11] 4,398,620

[45] Aug. 16, 1983

[54] APPARATUS FOR SUPPORTING A WORKING PLATFORM ON A PITCHED ROOF

[76] Inventor: Clyde D. Townsend, 61 Bortz St., Ashville, Ohio 43103

[21] Appl. No.: 245,543

[22] Filed: Mar. 19, 1981

[51] Int. Cl.[3] ..... E04G 3/12; E04G 3/10; E04G 1/24

[52] U.S. Cl. ..... 182/45; 182/17; 182/142

[58] Field of Search ..... 182/45, 206, 15, 17, 182/142, 143, 144, 150, 147, 222; 280/43.24, 280/DIG. 7, 79.1 A; 248/237, 148

[56] References Cited

U.S. PATENT DOCUMENTS

| | | | |
|---|---|---|---|
| 340,573 | 4/1886 | Hamlin | 182/206 |
| 677,645 | 7/1901 | Elkins | 182/45 |
| 994,424 | 6/1911 | Prose | 182/45 |
| 1,650,324 | 11/1927 | Campbell | 182/45 |
| 2,176,551 | 10/1939 | Solem | 280/43.24 |
| 2,231,560 | 2/1941 | Campion | 182/45 |
| 2,708,543 | 5/1955 | Matich | 182/45 |
| 2,840,424 | 6/1958 | Broderick | 182/45 |
| 3,123,168 | 3/1964 | Atwood | 280/DIG. 7 |
| 3,292,734 | 12/1966 | Swanberg | 182/45 |
| 3,526,296 | 9/1970 | Stevens | 182/45 |
| 4,132,287 | 1/1979 | Parolini | 182/45 |
| 4,186,820 | 2/1980 | Cosman | 182/206 |

FOREIGN PATENT DOCUMENTS

| | | | |
|---|---|---|---|
| 540763 | 5/1957 | Canada | 182/45 |
| 1063795 | 8/1959 | Fed. Rep. of Germany | 182/45 |

*Primary Examiner*—Reinaldo P. Machado
*Assistant Examiner*—Alvin C. Chin-Shue
*Attorney, Agent, or Firm*—Millard & Cox

[57] ABSTRACT

Apparatus for supporting a working platform on a roof comprises hook members for engaging the roof cap, a cable extending downwardly from the hook member and a support unit attached to the lower end of the cable and provided with a winch so that it can be moved up and down the cable. The apparatus is used in pairs or larger numbers with an elongate working platform supported on the support unit of each apparatus. The support units can roll up and down the roof on balloon tires and are provided with a chassis section lying close to and parallel to the roof so that if the support units are overloaded the balloon tires will deform and the chassis section will come into contact with the roof, thereby spreading the load and reducing the risk of damage to the roof.

6 Claims, 3 Drawing Figures

APPARATUS FOR SUPPORTING A WORKING PLATFORM ON A PITCHED ROOF

BACKGROUND OF THE INVENTION

The invention relates to apparatus for supporting a working platform on a pitched roof.

When roofs are being covered with shingles, or when it is necessary to gain access to roofs in order to replace shingles, it is desirable to be able to dispose adjacent the roof a horizontal working platform on which the roof workers can stand or kneel in order to carry out the necessary placement of shingles. However, supporting such a working platform is fraught with considerable difficulty. Hitherto, roof work has either been conducted from crawl ladders lying flat against the roof, such crawl ladders having at their upper ends a hook section which engages the roof cap, or large scaffolding frameworks have been fixed to the roof, such scaffoldings usually extending across both sides of the roof in order to ensure that they cannot move relative thereto. Whilst crawl ladders are light in weight and can be rapidly placed in position or moved from one working location to another, on very large or steep roofs it may be difficult to provide a ladder of sufficient length which is easily manhandled and it may also be difficult to retain the ladder in position on very steep roofs. Furthermore, from a crawl ladder a worker can only reach a very limited area of the roof, so that it is necessary to move the crawl ladder frequently, and crawl ladders do not provide any suitable place for storing a stack of shingles prior to placing them on the roof. Permanent scaffolding allows ready access to large roof areas, but the erection and dismantling of such scaffolding is very labor-intensive and costly, so that the labor costs in erecting and dismantling the scaffolding may constitute a substantial proportion of a reroofing job. Where only a small proportion of the shingles on a large roof have to be replaced, for example because of storm damage, it is economically impractical to erect permanent scaffolding which will afford access to all the damaged shingles scattered over the entire roof. Finally, the weight of permanent scaffolding may present a problem since the shingles used on most roofs are not very strong and may be damaged by the weight of the scaffolding.

There is thus a need for some way of supporting a working platform on a pitched roof which would provide a large platform, thus providing access to a large section of the roof, but which is suffficiently light in weight not to present any danger of damage to the roof and to be easily manhandled onto the roof. In addition, it is desirable that such a working platform provide sufficient storage space to enable one or more bundles of shingles, tools or other equipment to be stored close at hand for a worker who is covering a roof. Moreover, because such apparatus may be used on roofs having differing pitches, it is desirable that a way be provided of keeping the working platform accurately horizontal regardless of the pitch of the roof. This invention provides such an apparatus.

SUMMARY OF THE INVENTION

The invention provides apparatus for supporting a working platform on a pitched roof, this apparatus comprising three principal sections, namely means for engaging the roof adjacent the roof cap thereof, a support unit movable up and down the incline of the roof and suspension means (usually in the form of a cable) for interconnecting the roof-engaging means and the support unit. The roof-engaging means is provided with means for fixing one end of the suspension means thereto. The support unit comprises a base member and trolley means (usually in the form of wheels) capable of allowing the support unit to roll across the roof. The base member has a chassis section which, when the trolley means are in contact with the roof, lies substantially parallel to and adjacent the roof. The trolley means permits the chassis section to approach closer to the roof as the load on the support unit increases so that when this load exceeds a predetermined volume the chassis means contacts the roof. In this way, the range of damage to the roof caused by overloading the support member is avoided; the aforementioned predetermined load is fixed so that, if the load on the trolley means becomes so great that there is a risk of damaging the roof, the chassis section of the base member will come into contact with the roof, thereby providing a much larger area over which the load can be spread and reducing the weight per unit area imposed upon the roof.

The support unit is also provided with lockable winch means for retaining the lower end of the suspension means and for varying the length of that part of the suspension means extending between the support unit and the roof-engaging means, and with a platform supporting member which is pivotally mounted on the base member and lockable relative to the base member in a plurality of differing inclinations relative thereto. This arrangement enables a working platform resting upon the platform supporting member to be kept horizontal despite variation in the pitch of the roof; before the working platform is placed on the platform supporting member, the platform supporting member is pivoted relative to the base member until the platform supporting member is horizontal, and then the platform supporting member is locked in position relative to the base member. Although the instant apparatus may be constructed in a form which enables a single support unit to support a working platform (for example, the base member might be made in the form of a rectangular chassis having trolley means in the form of a wheel at each corner of the chassis and the platform supporting member might have the form of a flat plate extending across the whole width of the chassis), in order to permit the support units to be small and light as possible while still providing a large working platform, it is desirable to use the instant apparatus in an assembly comprising two of the instant apparatus spaced from one another along the length of the roof. In such an assembly, each apparatus has its engaging means engaged adjacent the cap of the roof, these engaging means being spaced from one another along this top cap. By adjusting the length of the suspension means of the two apparatus to be substantially the same, the support units may then be held at the same height on the roof but spaced apart a distance equal to the spacing between the roof-engaging members. An elongate working platform is then disposed so that it rests adjacent its opposed ends on the platform supporting members of the two apparatus, these platform supporting members naturally first being locked into a horizontal position. In this way I have found it practical to use a very compact form of support unit weighing only about 60 pounds, while still providing a plank-like working platform 20 feet or more in length.

In the instant apparatus, the roof-engaging means preferably comprises a hook-shaped member having at least one plate pivotally mounted at one end thereof and the means for fixing one end of the suspension member thereto adjacent the opposed end of the hook-shaped member. Because electrically operated winches are too heavy and because the provision of power supplies to a roof is likely to be very inconvenient, I prefer that my winch be manually operable but provided with locking means for locking the winch, thereby retaining the support unit in a fixed position relative to the engaging means.

DETAILED DESCRIPTION OF THE DRAWINGS

Figure 1:
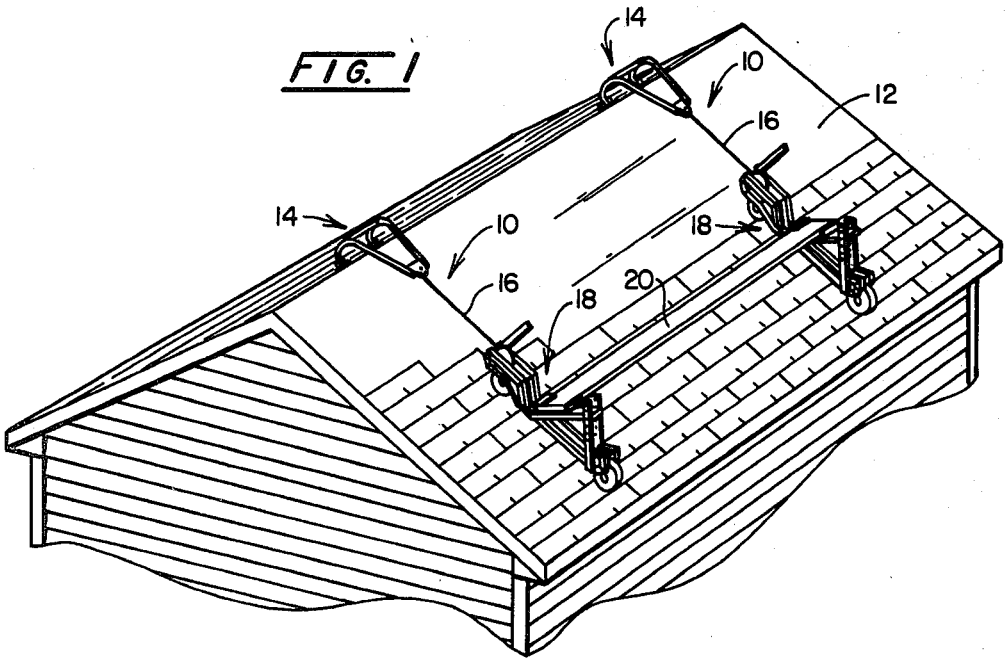
FIG. 1 shows my assembly in position on a roof.

FIG. 1 shows an assembly of the invention comprising two units, each generally designated 10, in a working position on a roof 12 whereon shingles are being laid. Each of the units 10 comprises a roof-engaging means 14 in the form of a hook-shaped member engaging the top cap of the roof, a suspension means in the form of a cable 16, the upper end of which is fixed to the member 14 of that unit, and a support unit 18 attached to the lower end of the cable 16. An elongate working platform in the form of a plank 20 extends between the two support units 18. It will be seen that the plank 20 permits access along its whole length (20 feet) to the portion of the roof lying adjacent thereto. Furthermore, by adjusting the lengths of the cable 16 extending between the members 14 and the support units 18 in the manner described below, the support units 18 can be moved up and down the incline of the roof and thus, without detaching the members 14 from the roof or removing the plank 20 from the support units 18, access may be gained to that whole part of one side of the roof which lies between lines running down the incline of the roof from the point at which the members 14 engage the top cap.

Figure 2:
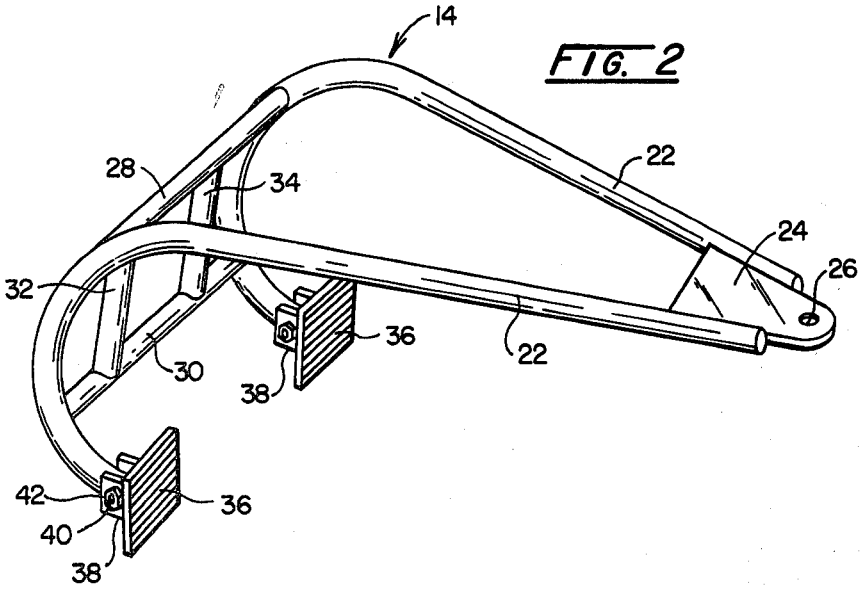
FIG. 2 is a perspective view of one of the roof-engaging means shown in FIG. 1.

One of the members 14 is shown in more detail in FIG. 2. As shown in that figure, the member 14 comprises two substantially J-shaped side pieces 22. The ends of the straight portions of the side pieces 22 are welded to opposed sides of a substantially triangular plate 24 having an aperture 26 therethrough. The aperture 26 permits the cable 16 to be attached to the member 14.

The curved portions of the two side pieces 22 are interconnected by tie bars 28 and 30, these tie bars 28 and 30 themselves being interconnected by reinforcing members 32 and 34 which extend at right angles to the tie bars 28 and 30. The tie bars 28 and 30 and the reinforcing bars 32 and 34 keep the side pieces 22 at the correct distance apart, thereby giving rigidity to the member 14.

A metal plate 36 is pivotally mounted on the end of the curved section of each side piece 22. This pivotal mounting is affected by affixing to one face of each plate 36 a pair of spaced apart angle brackets 38, each of these angle brackets 38 having an aperture (not shown) passing through its upstanding limb. A bolt 40 is passed through the apertures in both the angle brackets on the plate and through an aperture of the same diameter formed adjacent the end of the curved section of the side piece 22 associated with that plate and is secured in position by a nut 42. It will be appreciated that the two plates 36 may be replaced by a single elongate plate mounted on both side pieces 22.

The face of each plate 36 opposite to that on which the angle brackets 38 are mounted is provided with a rubber pad having a plurality of parallel ridges to assist this face (which is in contact with the roof when the member 14 is in the position shown in FIG. 1) to grip the roof 12. On steeply pitched roofs (those in which the internal angle of the roof cap is not more than about 90° ) the friction between the plates 36 and the roof 12 is sufficient to retain the members 14 in position. However, on more shallowly pitched roofs, there may be a tendency for the plates 36 to slide up the roof 12 and over the top cap thereof. To avoid the obvious dangers this presents, each of the plates 36 may be nailed to the roof with one or more suitably sized nails, in the same manner as has hitherto been done with some types of crawl ladders.

Figure 3:
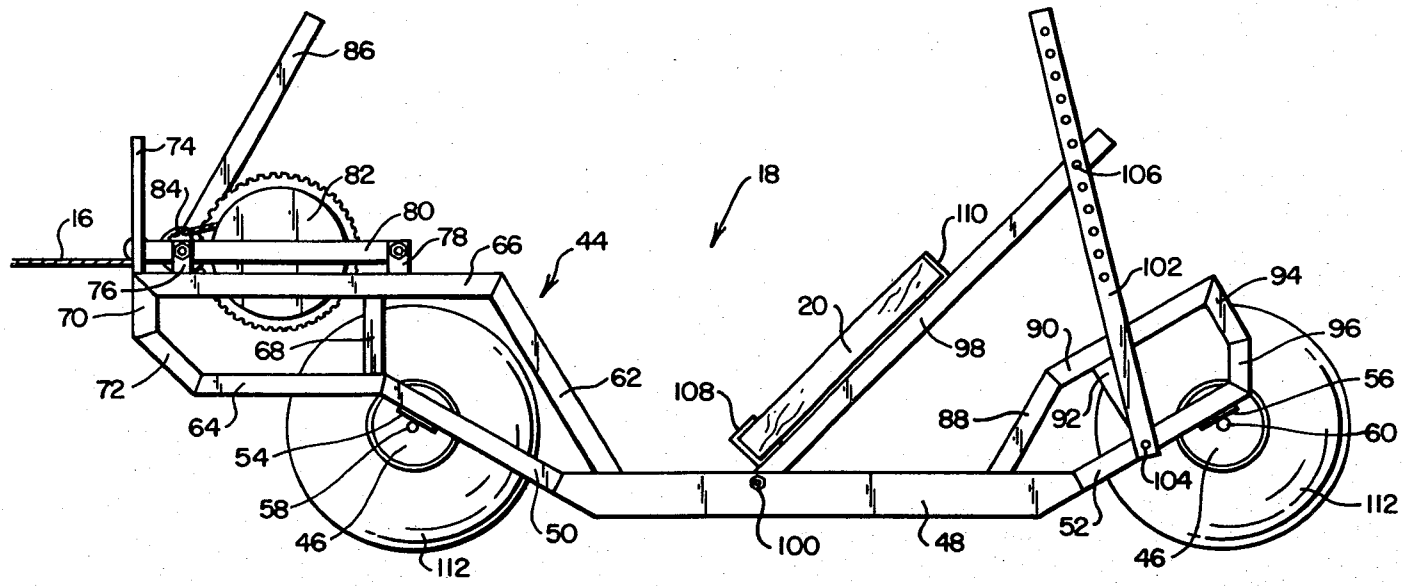
FIG. 3 is a side elevation of one of the support units shown in FIG. 1.

FIG. 3 shows in more detail one of the support units 18 of the assembly shown in FIG. 1. The support unit 18 shown in FIG. 3 comprises a base member generally designated 44 mounted upon trolley means in the form of a pair of wheels 46 disposed adjacent opposed ends of the base member 44.

For convenience, hereinafter, the left-end of the unit 18 shown in FIG. 3 will be referred to as the forward end (it is of course this end which is the uppermost part of the unit 18 when the unit is in the position shown in FIG. 1) while the opposed end of the unit 18 will be referred to as the rearward end, while "upwardly" is used to refer to the direction away from and perpendicular to the roof 12.

The base member 44 comprises, as shown in FIG. 1, two identical subunits lying in parallel planes on either side of the wheels 46 and interconnected in a manner described below. Only one of the subunits is visible in FIG. 3 and only this subunit will be described in detail, since the same details apply to the other subunit also.

The subunit shown in FIG. 3 comprises a chassis section 48 which, when the support unit 18 is in its working position shown in FIG. 1, lies close to and parallel to the plane of the roof 12 (indicated by the broken line in FIG. 3). The chassis section 48 is supported at its opposed ends by axle-carrying members 50 and 52 which extend upwardly from the chassis section 48 at an angle of approximately 30°. The members 50 and 52 have, adjacent their upper end plates 54 and 56 respectively bolted thereto. The plates 54 and 56 carry axles 58 and 60 respectively, on which are rotatably mounted the wheels 46.

The forward end of the chassis section 48 is also supported by a diagonal strut 62. From the upward ends of the member 50 and the strut 62, horizontal members 64 and 66 extend forwardly, the members 64 and 66 being interconnected by means of a tie bar 68. The forward ends of the members 64 and 66 are interconnected by means of a vertical member 70 which extends downwardly from the forward end of member 66 and a diagonal member 72 which interconnects the lower end of member 70 and the forward end of member 64. From the junction of members 66 and 70, a solid rod 74 extends upwardly to serve as a handhold for a worker on the support unit 18.

Two support lugs 76 and 78 extend upwardly from the member 66. The upper ends of the lugs 76 and 78 are bolted to a winch-carrying member 80 which extends parallel to member 66. The winch-carrying members 80 of the two subunits of the base member 44 support a lockable, manually-operable winch comprising a drum 82, a drive pinion 84 and a handle 86. The cable 16, which is a ¼ inch steel cable, passes over the drive pinion 84 and is wrapped around the drum 82. It will be appreciated that by operation of the winch, the length of cable extending between the member 14 (FIG. 1) and the support unit 18 can be varied, and the support unit 18 thus moved up and down the roof.

The rearward end of the chassis section 48 is supported not only by the member 52 but by a strut 88 which extends upwardly from the chassis section 48 at substantially the same angle as the strut 62. From the upward end of the strut 88 extends a diagonal member 90 which extends parallel to the member 52, the members 52 and 90 being interconnected by means of a tie bar 92. From the rearward end of the member 90 and perpendicular thereto extends a member 94, the lower end of which is connected to the rearward end of the member 52 by means of a strut 96.

The two subunits of the base member are interconnected by cross-bars which extend perpendicular to and interconnect the two subunits at the following points (none of the cross-bars are visible in FIG. 3).

(a) adjacent the centre of the chassis section 48 immediately beneath a point which supports the platform supporting member (described below);

(b) on the members 50 and 52 adjacent their junctions with the chassis section 48.

(c) on the member 66 adjacent its junction with the strut 62 and (d) on the member 90 adjacent its junction with the strut 88.

A substantially U-shaped platform supporting member 98 is pivotally mounted on both chassis sections 48 adjacent the midpoints thereof by means of pivots 100 (only one of which is visible in FIG. 3). A substantially U-shaped adjustment member 102 is pivotally mounted on the members 52 of both subunits by means of pivots 104 which lie at the junctions of the members 52 with their associated tie bars 92. Each elongate side limb of the adjustment member 102 has a plurality of spaced bores passing therethrough, the bores in the two side limbs of the adjustment member being aligned with one another. A pin 106 is passed through a pair of aligned bores in the two side limbs of the adjustment member 102 and through a pair of aligned bores (not shown) formed in the two side limbs of the platform supporting member 98 at points remote from the pivots 100. The pin 106 thus locks the platform supporting member 98 and the adjustment member 102 together, thereby preventing the platform supporting member 98 from pivoting relative to the chassis section 48 and holding the platform supporting member 98 at a fixed inclination relative to the chassis section 48. The pin 106 may readily be removed manually from the bores in the adjustment member 102 and reinserted through a different pair of aligned bores in the adjustment member 102 and through the same bores in the platform supporting member 98, thus altering the inclination at which the platform supporting member 98 is locked relative to the chassis section 48. The variable inclination of the platform supporting member 98 relative to the chassis section 48 thus provided enables the platform supporting member to be retained in a horizontal working position despite wide variations in the pitch of the roof 12 on which the support unit 18 is being used.

Extending transversely (parallel to the axes of the axles 58 and 60) across the platform supporting member 98 are a substantially U-shaped channel section 108 and an L-shaped angle section 110. To permit the apparatus to be used with various types of working platform, the sections 108 and 110 are detachably bolted to the member 98 and can be replaced with other types of platform retaining means to hold other types of platforms. The spacing between the U-section 108 and the angle section 110 is such that the 12 inch wide plank 20 just fits therebetween so that the plank 20 is held fixed in position relative to the platform supporting member 98. To reduce any tendency for the plank 20 to twist about an axis parallel to the plane of FIG. 3 when a load is imposed thereon, the sections 108 and 110 are extended outwardly beyond the side limbs of the platform supporting member 98; the limbs of the platform supporting member are only 6½ inches apart (measured to the outward sides of each limb) but the sections 108 and 110 are 12 inches long. To provide greater rigidity to the platform supporting member 98, the two side limbs thereof are interconnected by a cross-bar immediately adjacent the section 110.

The wheels 46 carry low-pressure pneumatic ("balloon") tires 112. To prevent damage to shingles over which the tires run, the tires should operate at a pressure not exceeding about 12 psig and preferable at a pressure in the range of 7–10 psig. Because the tires 112 are readily deformable, as the load on the platform 20 is increased the tires will deform in such a way as to increase their area of contact with the roof 12 and thus provide a greater area over which the load on the support unit 12 is spread. Furthermore, because the chassis sections 48 are arranged to lie parallel and close to the roof 12 when the support unit 18 is in its working position, as the load on the support unit 18 is increased and the tires 112 deform, the chassis sections 48 will approach more and more closely to the roof 12 until, when the load on the support unit 18 exceeds a predetermined value, the chassis sections 48 will contact the roof 12, thereby spreading the load on the support unit 18 over a much greater area and avoiding any danger that overloading of the support unit 18 will cause damage to the roof on which it rests. The proximity of the chassis section to the roof 12 also reduces damage to the roof should one of the tires accidentally break through. For the specific embodiment illustrated in the drawings, in which the wheel base of the support unit 18 is 35 inches, the tires 112 are 11.00×4.00 balloon tires and the length of the straight lower edges of the chassis sections 48 are approximately 19 inches, I have found it convenient to arrange for the spacing between the underside of the chassis sections 48 and the roof to be not more than 1 ½ inches before the plank 20 (which is a standard 20 foot ×12 inches by 1½ inches hardwood plank though other sizes of plank can of course be used) is installed, and for the spacing between the underside of the chassis sections 48 and the roof to be approximately 1½ inches when the plank 20 is installed but before any load is placed thereon. With the tires operating at a pressure of about 8 psig, and using two support units 18 in the arrangement shown in FIG. 1, the chassis sections 48 will contact the roof 12 when the load on each chassis unit is in the range of about 500 to 750 pounds. Naturally, the balloon tires would be replaced by a more rigid form of tire and the approach of the chassis section 48 to the roof 12 as the load on the support unit 18 increases controlled by coil springs or other suspension units mounted between the axles 58, 60 and the other parts of the base member 44. However, balloon tires are less likely to damage roofs than other types of tires and it is more economical to use balloon tires than to use other tires and incorporate separate suspension units.

The base, platform supporting and adjustment members of the support unit 18 are made of aluminum tubing in order to reduce the weight thereof. The entire unit only weighs about 60 pounds so that it can easily be manhandled onto the roof by a single man working from a ladder.

To place the assembly shown in FIG. 1 in position, a worker carries the two roof-engaging members 14 up a ladder positioned against the side of the building on which the roof rests; since the members 14 are made of mild steel tubing, (except for the plates 36 which are made of mild steel) and only weigh about 20 pounds each, both members 14 can easily be carried by a single person ascending a ladder. The worker ascends to the cap of the roof 12 in any conventional manner, either by using a crawl ladder placed across the roof or by holding onto a rope which is thrown across the cap of the roof and held by a colleague on the other side. The worker places the members 14 in position on the cap of the roof, if necessary nailing the plates 36 to the roof. A second worker then carries one of the support units 18 to the top of the ladder; conveniently the platform supporting member 98 of the support unit 18 is locked to the correct angle so that it will lie horizontally when the support unit 18 is on the roof. The second worker places the support unit 18 on the roof adjacent the ladder. The first worker then drops a rope to the second worker who attaches this rope to the cable 16 (which is already attached to the winch on the support unit). The first worker then pulls the rope, thereby dragging the cable 16 up to the roof cap, where the first worker attaches it to the member 14. This process is then repeated with the other support unit. Finally, the worker carries the plank 20 up onto the roof, inserts one long edge of the plank into the U-shaped sections 108 of the two support units 18, then lets the plank fall so that the rearward edge thereof fits into the angle sections 110. Since the two-wheeled support units 18 will not remain upright until the plank 20 is in position, it will be found more convenient to have the insertion of the plank 20 between the sections 108 and 110 performed by two men each of whom holds one of the support units 18 upright in the appropriate position and inserts one end of the plank thereinto. Alternatively, the support units 18 may be modified by providing stabilizer wheels extending outwardly from the chassis sections 18 and contacting the roof to hold the support units 18 in their correct vertical planes before the plank 20 is inserted. Desirably, such stabilizer wheels should be made retractable so that they will fold up against the chassis sections 48 once the plank 20 has been placed in position.

Once the assembly shown in FIG. 1 has thus been assembled with the support units 18 adjacent the edge of the roof, the winches on the support units may be operated to raise the support units to any desired height on the roof and then locked in position to keep the support units 18 in their desired positions.

The apparatus shown in FIGS. 1–3 may of course be used for purposes other than placing shingles on a roof. For example, the apparatus may be used for painting roofs especially steeply-pitched metal roofs such as are often found on barns and industrial buildings. When painting a roof, the working platform is initially raised to a position adjacent the roof cap and progressively lowered down the roof as the work progresses to avoid running the tires of the support units across previously painted areas. The apparatus may also be used for placing solar panels on roofs and for installing plywood or sheeting on the eaves during construction work on a building. Finally, the apparatus may be used for work on chimneys such as repointing or flashing.

It will be apparent to those skilled in the art that numerous changes and modifications may be described in the aforementioned apparatus without departing from the scope of the invention. For example, the working platform, the plank 20 could be provided with a guardrail along its rearward edge to prevent workers from accidentally falling therefrom. The wooden plank 20 may be replaced by one of the commercially-available aluminum planks. If the apparatus is to be used on single-pitch roofs (so that the plates 36 must contact the top of a vertical wall) so changes in the shape of the member 14 may be desirble. It should be noted that, especially if the platform 20 is made very long, more than two support units 18 may be used to prevent the middle portin of the platform 20 contacting the roof; in this case, the platform 20 is of course supported on the platform supporting members 98 of all the support units. Accordingly, the foregoing description is to be construed in an illustrative and not in a limitative sense, the scope of the invention being defined solely by the appended claims.

What is claimed is:

1. Apparatus for supporting a working platform on a pitched roof, comprising:

means for engaging said roof adjacent the roof cap thereof;

a support unit moveable up and down the incline of said roof;

suspension means for interconnecting said engaging means and said support unit;

said engaging means having means for fixing one end of said suspension means thereto;

said support unit comprising a base member and trolley means for allowing said support unit to roll across said roof, said base member having a chassis section which, when said trolley means contacts said roof, lies parallel to and adjacent said roof, said trolley means permitting said chassis section to approach closer to said roof as the load on said support unit increases so that when the load on the support unit exceeds a predetermined value, said chassis section will contact said roof;

said support unit further comprising lockable winch means mounted on said base member for retaining the other end of said suspension means and for varying the length of said suspension means between said support unit and said engaging means, and a platform supporting member pivotally mounted on said base member and lockable relative to said base member at a plurality of differing inclinations relative thereto, said platform supporting member being capable of retaining a working platform thereon;

said platform supporting member being provided with a substantially U-shaped channel section extending transversely thereon and an L-shaped section spaced from and facing but extending substantially parallel to said U-shaped section, thereby enabling a working platform to be retained therebetween, said trolley means comprises a pair of wheels adjacent opposed ends of said base member, low-pressure pneumatic tires of equal diameter being mounted on said wheels, said tires having internal pressures not exceeding about 12 psig., each wheel being mounted on an axle and a line drawn between said axles being parallel to said chassis section, the spacing between said chassis section and said roof does not exceed $1\frac{1}{2}$ inches when no load is imposed on said support unit and said trolley means permits said chassis section to touch said roof when said load on said support unit exceeds about 750 lbs.

2. Apparatus according to claim 1 wherein said engaging means comprises a hook-shaped member having at least one plate pivotally mounted at one end thereof and said means for fixing said one end of said suspension member adjacent the opposed end thereof.

3. Apparatus according to claim 1 wherein said winch means comprises a manually operable winch provided with locking means for locking said winch.

4. Apparatus according to claim 1 wherein an elongate adjustment member is pivotally mounted on said base member, said adjustment member having walls defining a plurality of apertures extending through said adjustment member, said apertures being spaced from one another along said adjustment member, and wherein said platform supporting member has walls defining an aperture therethrough, such that a pin can be inserted through one of the apertures in the adjustment member and through the aperture in the platform supporting member, thereby locking the platform supporting member in position relative to the base member.

5. An assembly for working on a roof comprising at least two apparatus according to claim 1, each said apparatus having its engaging means engaged adjacent the roof cap of said roof, said engaging means being spaced from one another along said roof cap, and each apparatus having its platform supporting member locked relative to its base member, so as to extend substantially in a horizontal plane, and an elongate working platform mounted on said platform supporting members of said apparatus so as to be supported by the support units of each apparatus.

6. Apparatus according to claim 5, wherein an elongate adjustment member is pivotally mounted on said base member, said adjustment member having walls defining a plurality of apertures extending through said adjustment member, said apertures being spaced from one another along said adjustment member, and wherein said platform supporting member has walls defining an aperture therethrough, such that a pin can be inserted through one of the apertures in the adjustment and through the aperture in the platform supporting member, thereby locking the platform supporting member in position relative to the base member.

* * * * *